United States Patent [19]

Pickett

[11] 4,138,947

[45] Feb. 13, 1979

[54] NOISE BARRIER

[76] Inventor: William H. Pickett, 44 Lake Rd., Framingham, Mass. 01701

[21] Appl. No.: 785,454

[22] Filed: Apr. 7, 1977

[51] Int. Cl.[2] ..... G10K 11/04

[52] U.S. Cl. ..... 104/1 R; 181/210

[58] Field of Search ..... 104/1 R, 124; 105/144, 105/452; 181/210, 284, 293

[56] References Cited

U.S. PATENT DOCUMENTS

| | | | |
|---|---|---|---|
| 250,220 | 11/1881 | Dodson | 104/124 |
| 937,338 | 10/1909 | Strauss | 104/124 |
| 2,226,432 | 12/1940 | Heinze | 104/124 |
| 3,212,453 | 10/1965 | Lich | 104/124 |
| 3,604,361 | 9/1971 | Harbert et al. | 104/124 |
| 3,772,993 | 11/1973 | Noble et al. | 181/210 |
| 4,069,768 | 1/1978 | Matsumoto et al. | 104/1 R X |

FOREIGN PATENT DOCUMENTS

| | | | |
|---|---|---|---|
| 1142698 | 2/1969 | United Kingdom | 181/293 |

*Primary Examiner*—Francis S. Husar
*Assistant Examiner*—Randolph A. Reese

[57] ABSTRACT

Sound/noise barriers are shown that are useful along a noise source such as a rail or other right of way or next to a utility substation. The barriers have a profile characterized generally by an upwardly extending noise barrier wall and an upper, sideways projecting element. The wall reflects the noise to an advantageous point for absorption while the sideways projecting element performs a number of simultaneous functions. In various embodiments it serves as a barrier for upwardly reflected noise; as a protector, against the weather for sound absorptive devices, in particular sound absorptive materials that lie below it; as an emergency or safety walkway; as a beam strength structural element; as a support for another barrier placed above it; as a base in cases where the barrier is reversed for operation in a different mode; and as a cooperative element with noise baffles such as may be attached to rail cars and other noise sources. In the case of a reversible unit, the wall of the barrier is sloped to the vertical, and, depending upon selected orientation, reflects the noise either upwardly to the upper element of the unit or downwardly to base material upon which the unit rests. This base material may for instance be sound-absorptive ballast as found along railroads, transformer stations and the like. Barriers are shown which control noise coming from both sides and which provide additional functions such as protecting wiring systems and third rails along electric railways. In preferred forms the barriers are formed monolithic concrete modular units constructed as beams and having integral bases which can rest on ballast, piers or continuous structures. The units may be laterally retained as by molded channels in their bases, or may be stacked upon one another, for providing a higher sound control wall.

6 Claims, 21 Drawing Figures

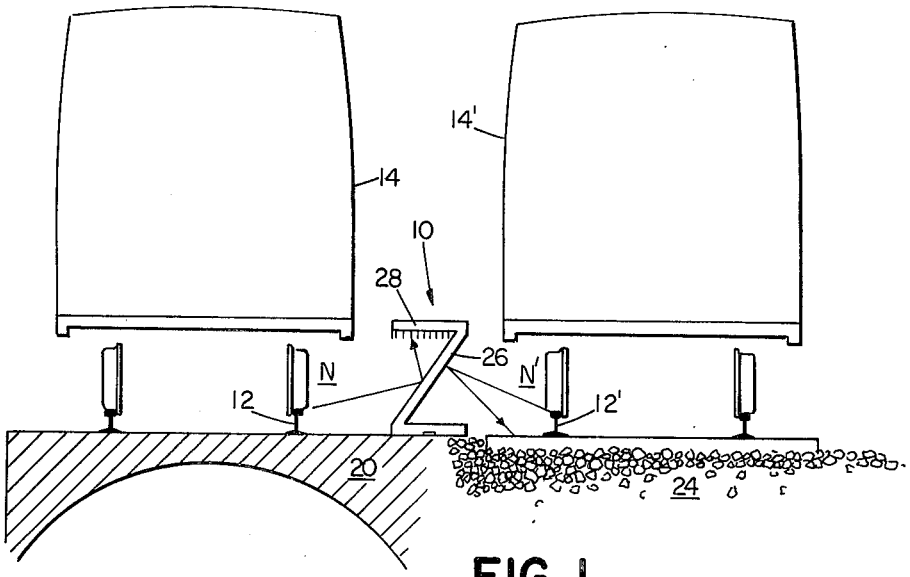
FIG 1
FIG 2
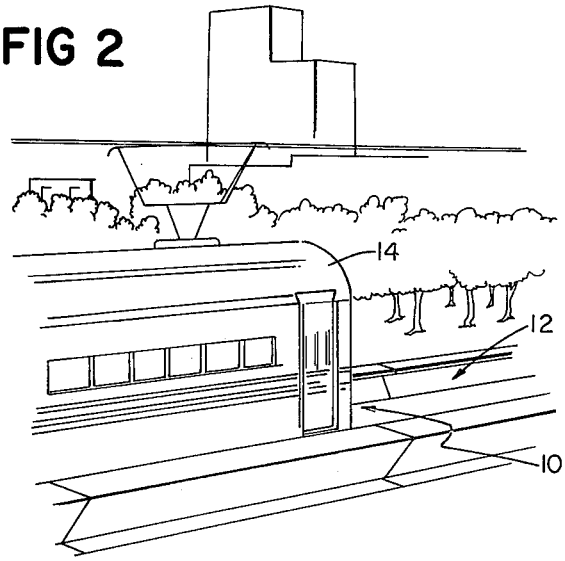
FIG 5
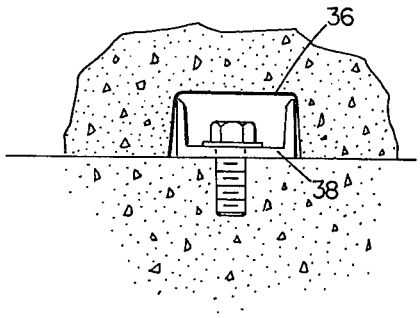
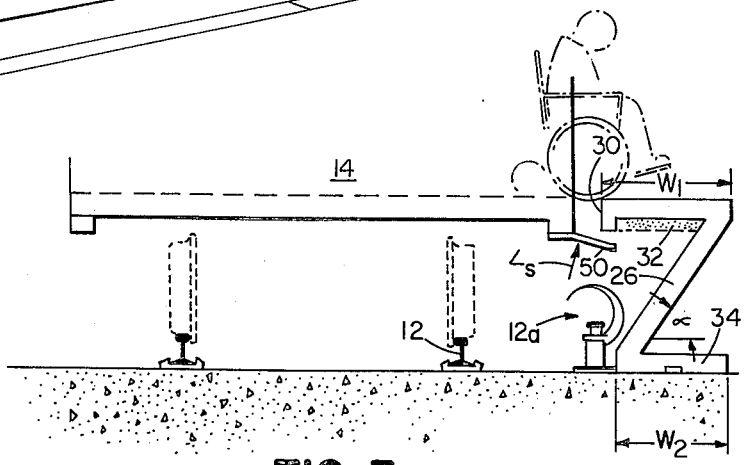
FIG 3
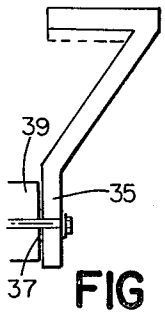
FIG 3a

NOISE BARRIER

This invention relates to improved noise control barrier structures with emphasis upon economy, practicality, and adaptability to various installation conditions and requirements.

In particular it is an object to provide such a noise control barrier which is of relatively low cost to manufacture, install and maintain. Preferred embodiments of the invention minimize the need for site preparation, are adaptable to many different exterior weather and site conditions, are durable, and can be readily disassembled, salvaged, and replaced very accurately to enable unemcumbered maintenance of systems along which the barrier is installed.

A further object of the invention is to provide a noise control barrier for railroad and rapid transit rights of way.

The invention features a noise control barrier adapted for disposition close to a source that emits noise in sideward directions. According to one important feature, the barrier structure has a profile characterized by an upwardly extending barrier wall and an upper element that projects sideways relative to an upper portion of the wall. In many preferred embodiments the barrier wall slopes relative to the vertical and the upper element projects in the direction to overlie the body of the wall.

In a first mode of noise control, according to the invention, an upwardly directed surface of the sloped barrier wall faces the noise source and reflects noise upwardly to the underside of the upper element for absorption. In a second mode of noise control, the downwardly directed surface of the sloped wall faces the noise source and reflects the noise downwardly. In certain preferred embodiments a given unit can be employed in either mode, depending upon orientation, while in other embodiments the structure is constructed for use in only one mode. In either case the unit may be constructed to control noise emanating towards it from either side. For absorbing sound when the barrier structure is used in the first mode, sound absorptive material is preferably fixed below and protected by a relatively durable component of the upper element of the unit, of especial advantage where the barrier device is exposed to weather conditions. For absorbing sound when the barrier structure is used for the second mode, the sidewall is constructed to reflect noise downwardly to noise absorbing material such as ballast of a railbed. Also in certain embodiments the upwardly extending barrier wall itself may comprise special sound absorptive material, protected in one cause by the overhanging upper element and in the other case by the negatively sloped, downwardly facing orientation of the barrier wall itself.

The barrier wall and upper element preferably comprise integral parts of a monolithic casting of reinforced concrete, with advantages in cost, strength, maintenance, and protection from fire and electrical shock. In certain preferred embodiments this casting also includes its own base element joined to the bottom part of the wall and extending at least in the direction to underlie the upper element. In certain preferred embodiments the noise control barrier structure has the cross-sectional profile of the number "7" or the letter "Z", while its reflective faces may be shaped in predetermined form, as for producing focusing surfaces for noise sources of predeterminable location.

For use along line sources of noise, a preferred embodiment of the invention is a noise barrier of elongated form with substantially the same cross-sectional profile throughout its length, preferably comprising a precast, portable concrete module adapted to be fixed in end-to-end relation with adjacent modules. In preferred embodiments as for use along railways, the upper, sideways projecting element provides a safe walking surface for persons walking along the right of way or leaving stalled trains.

In preferred embodiments of a modular barrier that includes a base element, a channel is preferably molded in the underside of the base, for engagement by lateral retainers, for instance to ensure that the structure remains at a safe distance from moving trains, even if removed and replaced for track maintenance purposes. In certain embodiments a noise-reducing Helmholz resonator is defined by the barrier structure, preferably the upwardly extending barrier wall defining one wall of the resonator, and either the upper element or the base of the barrier defining another resonator wall. In these cases the opening into the resonator is positioned to moderate noise emitted from the noise source, this opening being protected from the weather by the upper, sideways projecting element of the barrier. In embodiments where two sets of rail tracks lie side by side, to control the sound from both, duplex structures acting upon noise from both sides, define an above walkway and a protected space in which other systems for the railroad or rapid transit system may be positioned such as control cables and the like, providing protection against weather and damage. In other embodiments upper portions of the barrier structure, operative in either of the mentioned modes, are constructed to cooperate with baffles carried by the sides of railroad or rapid transit cars to block radiating noise. In cooperation with sound absorbing material supported and preferably protected by the barrier structure, a unique noise control is provided constituting a moving acoustically-lined bend through which any noise must pass before escaping.

These and other objects and features of the invention will be understood more fully from the following description of preferred embodiments taken in connection with the drawings wherein:

FIG. 1 is a cross-sectional diagrammatic view of a preferred embodiment of a sound control structure showing its relationship to noise-producing rapid transit vehicles for two different modes of reverberant sound control;

FIG. 2 is a pictorial view of a device such as shown in FIG. 1 installed along a rapid transit right of way;

FIG. 3 is a view similar to FIG. 1 illustrating in greater detail the relationship of the sound control structure of FIG. 1 in upwardly reflective mode, in relation to the operative systems of a rapid transit right of way;

Figure 4:
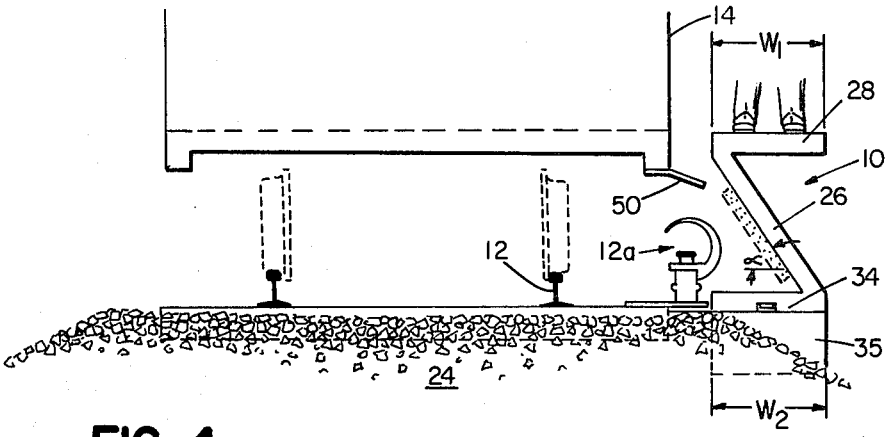
FIG. 4 is a view similar to FIG. 3 of an embodiment arranged for the downwardly reflective mode of operation.
Figure 6:
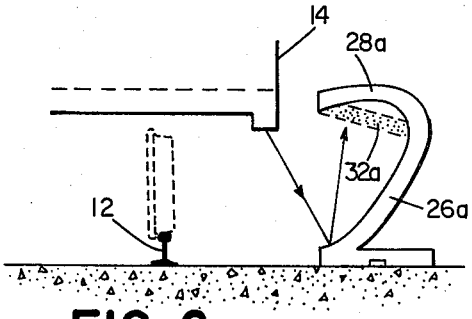
Figure 6A:
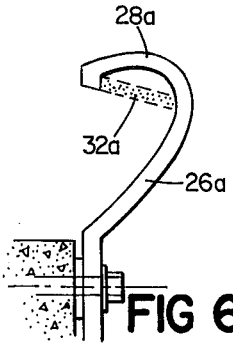
Figure 7:
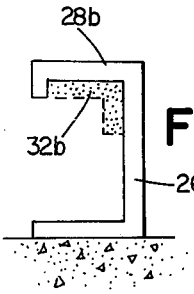
Figure 11:
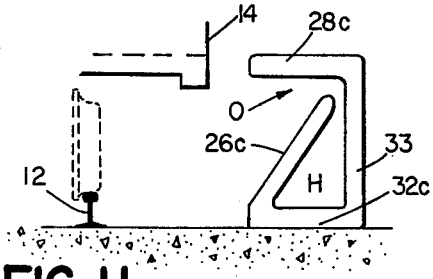
Figure 11A:
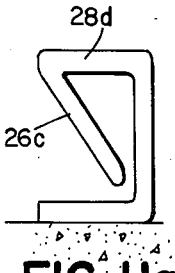
Figure 11B:
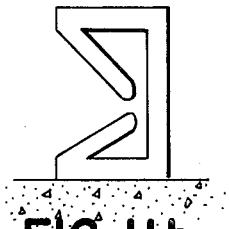
Figure 13:
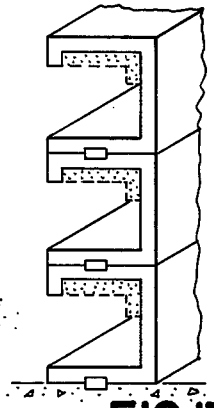
Figure 8:
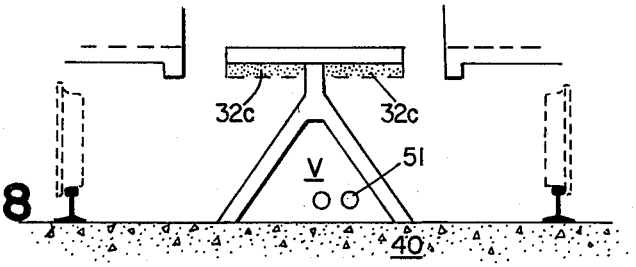
Figure 8A:
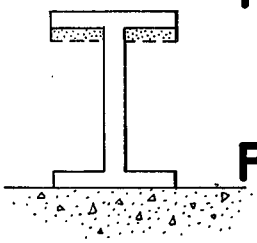
Figure 9:
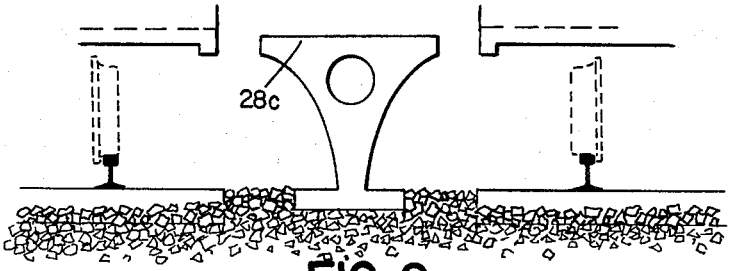
Figure 10:
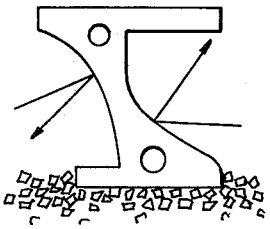
Figure 12:
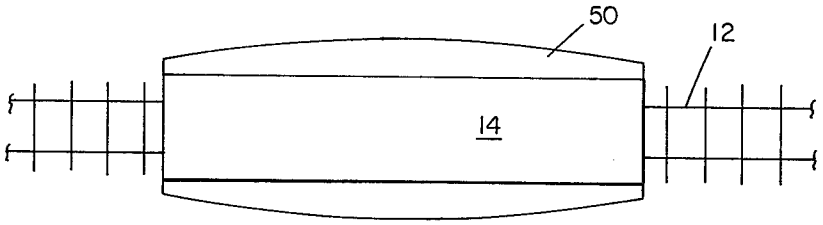
Figure 12A:
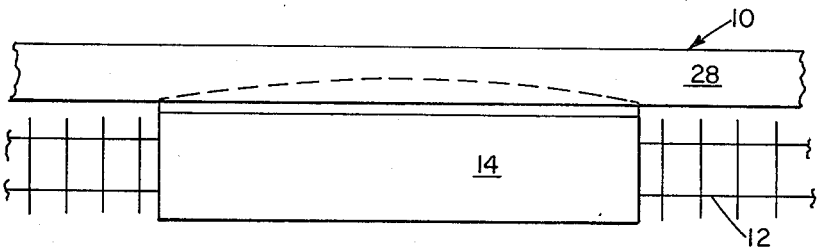
Figure 12B:
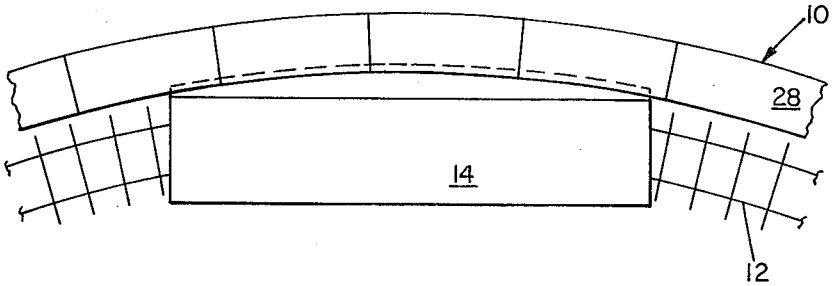
Figure 14:
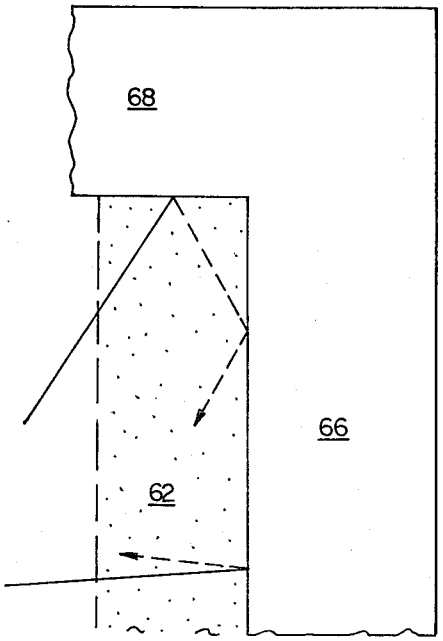

FIG 3*a* is an alternative embodiment to FIG. 3 with different mounting features;

FIG. 5 is a cross-sectional view on enlarged scale of the laterally adjustable channel iron detail of FIGS. 3 and 4;

FIG. 6 and 6*a* are views similar respectively to FIGS. 3 and 3*a*, of embodiments employing curved side and top elements;

FIG. 7 is a view similar to FIG. 3 of still another embodiment, having a vertical barrier wall;

FIGS. 8 and 8*a* are cross-sectional views of two different noise control structures adapted to control sound from two adjoining tracks via the upwardly reflective mode;

FIG. 9 is a view similar to FIG. 8 of a embodiment adapted to operate according to the downwardly reflecting mode;

FIG. 10 is a view similar to FIG. 1, of an embodiment employing curved reflective surfaces;

FIG. 11 is a view similar to FIG. 3 of an embodiment incorporating a Helmholz resonator, while FIGS. 11*a* and 11*b* are alternative embodiments of Helmholz resonator designs;

FIG. 12 is a plan view of a preferred rail car carrying a baffle element according to the invention while FIGS. 12*a* and 12*b* are similar plan views illustrating the location of the baffle element along straight and curved rights of way, respectively;

FIG. 13 is a perspective view of a wall formed of a stacked series of barrier units; and FIG. 14 is a diagrammatic illustration of still another embodiment.

Referring to FIG. 1 an elongated noise control structure 10 is shown in cross section in relation to railways for the two different modes of noise control. In FIG. 2 the same structure 10 is shown, without the details that define the mode of noise absorption, but showing the close proximity and height relationships of the noise control structure to the rail right of way 12 for controlling the noise emanating from beneath the rapid transit vehicle 14 as it proceeds along the rails.

Referring to FIG. 1, for simplicity of description, the reversible modes of operation of the noise control structure 10 are illustrated by showing rail rights of way on two sides of the structure 10. To the left side is rail 12 with the outline of the car 14. To the right-hand side the same elements are shown with the numbers primed. To the left-hand side the noise control structure 10 is shown mounted on and therefore is effectively sealed to a concrete viaduct or similar non-sound-absorptive surface 20 while on the right-hand side the noise control structure is mounted upon and sealed to the usual crushed rock ballast 24 of the roadbed, which, if in good condition, is sound absorptive.

The preferred sound control structure of FIG. 1 shown in larger scale in FIGS. 3 and 4, comprises, in cross section, a long, thin upwardly sloping sidewall 26 set at angle $\alpha$ to the horizontal, e.g., of the order of 55°, this sidewall 26 joined at its upper end to top element or wall 28 extending to overlie the sidewall 26 and terminating, in FIG. 3, at its free end at downwardly extending protective lip 30. Also in FIGS. 1 and 3, fixed beneath the top element 28, in a protected relation against weathering elements such as sun, wind and rain, is sound absorptive material 32 (e.g., bonded fiber glass or wood fibers bound with portland cement.) In this preferred embodiment in width $W_1$ of the upper element corresponds to the projection on a horizontal plane of the sidewall 26. Similarly in this embodiment a base element 34 is joined to the lower end of the sidewall, extending to underlie the sidewall 26, and has a substantial width $W_2$, the specific dimension determined by on-site conditions, e.g., for providing overturn resistance or for attachment to bases. Referring to the left-hand side of FIG. 1 and to FIG. 3 it is seen that the upwardly directed surface of the sidewall faces the noise source N. Noise emanating from between the rail car and the rails proceeds sidewards until striking the face of sidewall 26. As this wall is of noise barrier substance, e.g., a 2-inch thickness of concrete, most noise is reflected with angle of reflection being equal and of opposite sign to the angle of incidence. Accordingly, the effect of the upwardly sloped surface of sidewall 26 is to reflect the sound upwardly to be intercepted by the overhanging top element 28 and to be deliberately absorbed by the sound-absorptive material 32 fixed beneath. Thus by absorbing a substantial portion of the reflected noise, the noise control structure acts to significantly reduce the otherwise high intensity reverberant sound field beneath the rail car.

The protective top element 28 enables use below of relatively fragile sound absorptive materials 32, and as shown in FIG. 3, provides a walkway on its upper surface for right-of-way maintenance personnel, and evacuation of passengers from disabled trains, of particular importance for instance on viaducts and other rights of way having restricted width right-of-way space.

The top element 28 is effective also to define only a narrow open safety gap with the passing rail car further to ensure confinement of the noise and to enable secondary absorption of the residual sound energy by the bounding surfaces, the proper spacing being ensured by lateral retainers 38 engaged in channels 36 molded into the base 34 of the barrier unit.

In FIG. 3 the upper part of barrier 10 operative according to the upwardly reflective mode is shown in cooperative relation with a baffle element 50 extending along the length of the rail cars 14. Baffle 50 cooperates with barrier 10 to block all straight lines of sight Ls from beneath the rail car. Thus a practical, useful "lined bend" baffle effect with noncritical operating and car sway clearances is achievable between a moving rail car and the stationary noise control structure. (The sound barrier height is then chosen to be consistent with waiting platform height for clearance purposes.) Of similar effect is baffle 50 associated with the upper part of the structure operative according to the downwardly reflective mode of FIG. 4. Note also in FIG. 3 that the electrical third rail 12*a* is protected by the concrete unit 10.

Referring now to the right-hand side of FIG. 1, as well as to FIG. 4, here the downwardly surface of sidewall 26 is exposed to noise emanating from source $N_1$. Because of the aforementioned relation of angle of incidence to angle of reflection, the sound takes paths from the source similar to that shown on the left-hand side but is now reflected down rather than up, to take advantage of the sound absorptive characteristics of the crushed stone ballast 24 on which the rails and ties rest. In this case the gap between the barrier and passing cars is again held to the permissible minimum with the safety envelope for the vehicle, the gap being defined by the apex formed between the sidewall 26 and the top element 28, as set by the base channel 36 and retainer 38, see again FIG. 5. Again the third rail 12*a* is protected by unit 10.

In these embodiments the sidewall and top element are integral parts of a fireproof, weatherproof, nonelectric conducting material such as monolithic casting of reinforced concrete. The sidewall and top element cooperate to provide a great deal of beam strength, making it possible to provide long modules of 10 to 20 feet in length, capable of being handled by existing cranes used in handling steel rails, girders, etc, and of being supported at widely spaced intervals.

The base element 34 contributes significantly in adding bottom flange beam strength where extremely long modules are desired, and further it enables the unit to provide its own footing for vertical loads and resistance to overturn. Thus as illustrated in FIGS. 1 and 4, the integral base 34 may rest directly upon the surface of ballast or upon spaced apart base blocks 35, see FIG. 4., bodying the centrally adjustable channel iron detail.

In a particular embodiment for a rapid transit system, the noise control structure is of the "Z" cross-sectional profile shown, with:

angle $\alpha = 55°$
$W_1 = W_2 = 2$ feet
Height = $4\frac{1}{2}$ feet
Wall Thickness = 2 inches, average In this embodiment the base 34 serves to spread the vertical load over a large surface area, it provides a wide friction surface for resisting sideways sliding displacement, and it provides a wide base for resisting rotational overturning tendencies that result from the powerful, reversible pressure of air created by passage of the high speed rapid transit cars.

It will be noted that the elongated channel 36 molded or otherwise incorporated into the substance of the base is central to the width $W_2$ so as to be useful to retain the same safety gap if the structure is reversed end for end, and disposed for engagement by the same lateral retainers 38, as shown. From a comparison of FIGS. 3 and 4 it will be noted that the structures illustrated are of identical concrete cross section, having merely been turned end for end. The economics of mass production, warehousing and ease of handling thus realized are significant. With the barrier structure as shown it is possible to salvage units from obsolescent installations of one mode of noise control and to reuse them with complete resalvageability in the other.

The form of the reflective surfaces can be varied in accordance with various criteria. For instance rapid transit rail systems vary considerably from one another in the intensity of the sound and the points from which the sound emanates. In some cases curved walls such as suggested in FIGS. 6, 6*a*, 9 and 10 can be tailored to reflect sound from particular points most effectively. In the embodiments of FIGS. 6 and 6*a* the upwardly extending wall 26*a* is thus curved, and blends into the curved, sideways projecting upper element 28*a*, which by its curvature provides for water runoff, and protection of sound absorber 32*a*.

FIG. 10 illustrates a counterpart to FIG. 1, employing curved reflective surfaces resulting in non-uniform wall thickness and with weight-saving holes 37. In other cases simple channel constructions, with straight vertical walls 26*b* horizontal upper elements 28*b* and protected absorbers 32*b*, the structure retaining the walkway feature when used along rights of way, as suggested in FIGS. 7 and 8*a*, may be adequate.

Referring to FIG. 3*a* reversible modular structures are also achievable employing other forms of mounting, here illustrated by integral supporting legs 35. In this case specially installed spacers 37 are installed after rough installation of the supporting structure 39, which ensure offset of the supporting legs to achieve proper car clearance.

In the embodiment of FIG. 8 a duplex structure is illustrated for use between two sets of railroad tracks, the structure defining in effect two profiles in the form of the number "7", one the mirror image of the other, each associated with sound absorptive material 32*c* protected under an overlying top element that also defines a walkway. In this embodiment the lower portions of the sidewalls provide mounting legs which can be inserted into support brackets or grooves in the support structure 40, and cables or other systems 51 of the railway may be disposed in the central internal volume V protected by the noise control structure. FIG. 8*a* is a counterpart of FIG. 8 that employs the features shown in FIG. 7. FIG. 9 illustrates a duplex structure operative according to the downwardly reflective mode. Again the upper element 28*c* provides a walkway.

In the embodiment of FIG. 11 there are again an upwardly sloped sidewall 26*c* and a top element 28*c* projecting sideways relative thereto in overlying relation. However, in this embodiment for moderating the noise a Helmholz resonator is provided. Fo this purpose a restricted opening O is defined between the upper end of wall 26*c* and top element 28*c*, into chamber H defined by sidewall 26*c*, base element 32*c* and backwall 33. The chamber H thus comprises a Helmholz resonator with its restricted opening O exposed to the noise energy field. As is understood according to acoustic theory, the effect is to transform impinging noise energy into resonator reverberations that are damped. The top element here serves to direct the noise, to shield the resonator opening from the weather, ensuring its proper operation in inclement conditions, and provides the safety walkway.

Referring to FIG. 11*a*, by turning the structure of FIG. 11 upside down through rotation about the horizontal axis, a similar resonator design is achieved in a structure operative by the downwardly reflecting mode per FIG. 4. Here the restricted opening O is again protected by the top element 28*d*, as well as by the sidewall 26*c* and is self-draining, and the walkway is again provided.

The embodiment of FIG. 11*b* illustrates another of the possible variations, here there being two resonators whose openings are protected by the top element of the structure, which also provides the walkway.

Referring to FIGS. 12–12*b*, the baffle element along the length of a rail car 14 is preferably curved along its length, with greatest width in the center of the car to provide overlap with the barrier structure on curved (FIG. 12*b*) as well as straight track conditions (FIG. 12*a*).

FIG. 13 illustrates a series of precast barrier modules according to FIG. 7, stacked upon one another to define a noise control wall, such as may be used to surround a transformer substation or the like, for noise control purposes. Channels molded in the top and bottom surfaces, into which fit lateral retainers serve to preserve alignment between the modular units.

In FIG. 14, the face of vertical barrier wall 66 is covered with acoustical absorbent material 62, and an upper projection 68 extends from the wall 66 beyond the edge of material 62. While material 62 absorbs a portion of the sound in passing, the remaining sound energy strikes projection 68, and is reflected back through the material, for further absorption. Thus projection 68 serves as a barrier to sound and as a means for increasing the sound-absorbing effect of material 62 by preventing leakage of the sound absorbing material's edge at the top of the barrier.

To summarize certain aspects of the invention, a noise control structure, suitable for exterior use, capable of being fire resistant and nonconductive electrically, has been provided enabling in one unit desired combinations of the following features:

1. A noise barrier wall, attenuating the propagation of sound through it.
2. A noise absorber suitable for exterior use protecting and utilizing sound absorptive products developed for interior use.
3. A directable noise reflector for directing noise either into the absorber provided in the structure, or into absorber material available at the site.
4. Lined bend attenuation between two objects, one moving and one stationary.
5. Incorporation of a Helmholz resonator to moderate the sound energy field.
6. A safety walkway.
7. A safety fire barrier.
8. A safety shield for electrically conductive systems.

Although the noise barrier structure as described can have larger or smaller dimensions and be constructed of other materials, and be adapted for other uses, the rapid transit application has been chosen to exemplify many of the invention's unique functions because of the stringent criteria for such use.

Unlike other transport media—such as automobile, trucks, busses and aircraft—the exact lateral path in space of rapid transit vehicles is well established by its fixed trackage. Further, the effective noise source of the rapid transit vehicles operating on the tracks is predominately a line source located between the rails and the bottom of the car. These relatively exact spatial locations of both the line noise source and the vehicle clearance envelope profile enable close-proximity location of the noise control structure of the invention. (Close-proximity location for a barrier to the source noise is efficient because the height of the noise control structure is minimized while still subtending a substantial arc of noise radiation from the source.)

Close-proximity shielding of noise by a barrier however introduces acoustic considerations of face-to-face reflections and the resultant build-up of reverberant fields beneath and between vehicle sides and the noise barrier, but the directed reflection and/or absorption provided by the noise control structure of the present invention overcome these difficulties; the absorption of initial waves and reflections of sound waves, as achieved by the present invention, not only avoids build-up of reverberant noise fields to which the vehicle itself is exposed (as then might require added sound insulation on the vehicle itself) but also avoids eventual spillover of any intense reverberant field into the surrounding environment.

The single, modular, mass-produced rapid transit noise control structure enables the choice in a typical transit system, optionally, to either (1) reflect noise into the track ballast (typical ground level operation) or, (2) to absorb it if a hard track floor is present as, for example, in a tunnel or on a viaduct or with poor acoustic-absorbing quality ballast. Both options, of course, are in addition to the noise control structure's first function of serving as a barrier to through-wall noise propagation from the train to the surrounding environment.

In selection of which mode of noise control to employ, one should consider, in the first case, the ballast's sound spectrum absorbing quality in terms of particle size(s) and freedom from contamination by foreign matter, such as snow and accumulated debris, in rating its effectiveness at any time. In the second case of sound absorption by the noise control structure itself, two opportunities exist: either by sound absorptive materials or by the resonators as described.

Sound Absorptive Material

Economics has played an important role in the past developement of sound absorptive materials. Most currently available sound absorptive products were intended for interior use and are not regarded as suitable for exterior use. If employed for exterior use, such products when unprotected, are either temporarily or permanently disabled functionally by exposure to water, freezing, ultraviolet radiation, wind and abrasion. Therefore, it has been previously customary, when confronted with outdoor applications of such standard materials, to sheath the sound absorbing material with two protective coverings: (1) a moistureproof membrane bag, thin enough to allow passage of sound into the sound-absorbing material. (Such membranes are so fragile as to require a protective shield against abrasive damage); (2) protective shields against mechanical damage, in the form of separate, open work (sound-transmitting) structures such as slotted concrete blocks, wood or metal grills, or perforated sheets, generally of 50% open area and with drainage provisions between them and the moistureproof sheath. Such protective shield requirements have led to high cost.

According to the present invention, however, by placing the face of the sound absorbent material in its unique orientation and location for its protection, and then by reflecting the sound to be absorbed into this face, membrane sheathing and its protective shield become unnecessary.

Structural Integrity & Safety

Close-proximity location of a noise control structure in rapid transit use introduces other structural criteria of importance, but related to operational safety of the transit system rather than to acoustics. It will be seen that the present invention uniquely meets a host of these demanding criteria. The invention deliberately enables the acoustic shape of the noise control structure to be integrally strong, stiff and stable enough to establish and maintain safety clearance with the moving vehicles by enabling the unit to bridge its own supports horizontally and also to withstand high-intensity, reversible buffeting forces of the wind loads generated by passing trains. It enables dependable safety clearance, even if removed and replaced, with reliable placement and security laterally, and with a fixed attitude, so that any possibility of interference with train operation is virtually eliminated. It is further useful that this track-side noise control structure, in its preferred concrete embodiment, will be nonconductive electrically to eliminate local and distant electrical shock and fire hazards should it be brought into contact with the close-proximity power and communication equipment. It is also useful that the noise control structure's position and attitude is nearly tamper-proof without crane assistance.

An off-track safety walkway of proper height is deliberately provided by the invention for right of way workers and passenger emergency egress from side doors.

For initial erection, as well as for maintenance purposes, a free-standing, standardized, modular structural design made possible by the invention permits, with typical right of way maintenance type cranes, ready removal, interchangeability, and replacement with 100% salvageability of the structure both for major roadbed maintenance and for derailment clean up when required. Basically free-standing, on-grade installation virtually eliminates interference with below grade power/signal cable runs.

As described, a simple noise control structure compatible with all the foregoing criteria can have, for acoustic purposes, the cross section of the number "7", wherein the upper leg of the "7" profile can serve to provide a weather-shielded mounting for the uniquely horizontally-oriented acoustic material on a wall while the sloped leg or sidewall of the "7" profile can serve five purposes:

1. To reflect sound coming from the left up into the acoustic material located under the horizontal leg of the FIG. 7 cross section;

2. To reflect sound coming from the right downward (as into the track ballast material);

3. Both top and side serve as a simple barrier wall to through-wall noise transmission.

4. To serve the structural function of supporting the top element and, in conjunction with it, to form a stiff structural angle member suitable to resist the operational live and dead loads imposed upon it; and 5. To serve as a SAFETY WALKWAY.

The unique dual acoustic purpose of this design enables a long axial module of the number "7" cross section to optionally serve, as desired, either as a reflector or integral absorber for the typically long, line-source transit sound from one direction simply by reversing the module end for end.

It is not required that the cross section thickness of the module be uniform. In fact, the planes of opposing faces may be shaped as required for their particular functions:

1. The top plane at its unsupported edge may, as shown, have a downwardly oriented, drip-edge return for water-shedding purposes, further sheltering the adjacent acoustic material and supporting it. It will also stiffen the subject plane's unsupported edge.

2. The top surface of the top plane may be shaped or oriented from the horizontal to shed water, debris, conform to walkway or other uses.

3. The underside of the top member may be shaped, ribbed or otherwise equipped to support the sound absorbent material away from the general extent of the underside, in keeping with optimal installation practices for the selected acoustic material, thereby enhancing the efficiency of noise spectrum absorbency of the sound absorbing material when emplaced.

4. The sloped leg or sidewall of the cross section may be oriented at an angle or at a series of angles or curves, shaped such that with respect to the source(s) of noise(s) requiring treatment it will reflect sound waves back down into the track ballast, or up into the absorbing material. This optimum wall deflecting shape and location is a function of the profile of the roadbed and the car profile clearance envelope and various noise producing equipment found on the rolling stock of the particular rapid transit system to which the invention is applied.

The modules for this rapid transit application are recommended best made of reinformed concrete because (1) it is thermosetting plastic able to economically assume and hold complex shapes, (2) it has heavy mass to resist (a) through-wall penetration by sound, and (b) lateral or rotational movement by external forces, (3) it has high compressive and tensile strength, when reinforced, for stiffness and strength, (4) it is a poor electrical conductor, (5) its incombustibility, and (6) its freedom from maintenance.

Dimensions

The optimum, minimal width of the horizontal leg will be determined by one fourth the wavelength of the lowest frequency to be handled and by structural considerations as well as requirements of the particular use, it being understood that the requirement of rail rights of way, automotive rights of way, and transformer substations are very different. For typical rapid transit noise spectrum, a typical width dimension may be about 2 feet.

The sloped dimension of the reflector sidewall will be determined both by the pertinent acoustic parameters and by the particular transit system's roadbed profile and operating vehicle's floor height. This sidewall will be in a planned horizontal and vertical location with respect to the reference tracks so that, for a given angle, it reflects noise up into the acoustic material and, when the entire module is reversed, the opposite side reflects noise from the same source down into the ballast. The fact that these opposite surfaces of the inclined sidewall may be sloped and curved independently of each other to best perform functions of each side while also providing the structural support and rigidity requirements, is within the scope of this invention.

The sidewall or sloped leg of the structure will be designed to support the top element at an elevation along the lower portion of the side of the car body to permit wheelchair passenger egress if necessary, to block line-of-sight paths that the noise would follow from its source to the surrounding environment beyond the barrier and to minimize the opening between vehicle and wall which allows reverberant noise to escape. The sloped leg will be sized accordingly from this elevation down to the roadbed for continuous sound closure at ground or roadbed structure.

Support & Stability

The number "7" profile cross section is rotationally stable in only one orientation, and this inherent instability tendency is aggravated by its exposure to reversible horizontal wind buffeting from train passages. Accordingly, advantageous support methods are:

1. By embedded, fixed posts cantilevered vertically out of the ground and fitted matched hardware or detents cast into each end of each module. These attachment means are centered in the module laterally to allow end-for-end reversal of the modules, thus ensuring retention of the same moving car clearance vs the top edges of the modules in either end-for-end orientation.

2. When the wall is to be mounted on a viaduct carrying the tracks, the lower leg dimension may extend downward as a skirt or leg to the viaduct for the purpose of making a bolt-through connection with the side of the viaduct or, optionally, it may be pole-mounted with the poles secured to the viaduct (as in Case 1 above).

3. For free-standing applications of the noise control structure, another planar element is integrally cast into the bottom of the FIG. 7 cross section forming a "Z", forming a rotationally stable cross section and suitable also as a receiver for point vertical support along its length where convenient.

This rotationally stable design then utilizes spaced piles or blocks for vertical support and on top of such supports there is a laterally adjustable spline piece affixed, such as shown in FIG. 5. Such spline blocks are conveniently prealigned horizontally to the reference rails and securely fixed prior to installation of the "Z" modules. The "Z" modules have a standardized matching, longitudinal groove centralized on their bottom surfaces as mentioned. Thus when the modules are lowered into place and mated onto the fixed splines, the "Z" modules themselves become fixed in a known position with respect to the reference vehicle rail. The location-fixing grooves and splines are thereby completely concealed from weathering and tampering. Note that in the preferred reinforced concrete version recommended, each module would weigh several thousand pounds, sufficient to withstand wind forces applied, and to discourage tampering by humans without heavy duty cranes, jacks, or levers. (Other module construction materials, acoustically suitable for this invention but lighter in weight, such as metals, plastics or wood, would preferably require tie-down provisions, thus losing certain benefits of concrete such as walkway stiffness, fire resistance, maintenance freedom and electrical nonconductivity of concrete.)

4. Execution of the "Z" or "7" cross section in tunnels or viaducts can be either integral with construction of the basic tunnel or viaduct profile as cast, or they may be installed later by any of the preceding techniques.

5. In some applications, vertical stacking may be used.

Moving Lined Bend Concept

As previously described, using the underside of the top plane of the FIG. 3 or FIG. 4, the moving train as described can have a fin or baffle protruding from its side which passes below the referenced top wall plane without close tolerance, thereby blocking the line-of-sight noise escape route between the vehicle side and top edge of the barrier but without limiting the train sway. When the underside of the referenced wall plane and/or vehicle fin is surfaced with sound absorbing material, those skilled in noise reduction will recognize that a "moving lined bend" has been invented.

Numerous variations in the specific details of the invention and its application will be understood to be within the spirit and scope of the invention.

What is claimed is:

1. A sound control system for a moving rail vehicle comprising a closed road bed surface upon which the rails are mounted, and an upstanding closed, sound barrier element arranged to co-act with the moving rail vehicle to block lines of sight from the sound source beneath the vehicle to the exterior, said upstanding barrier and said moving vehicle including overlapping portions, defining a clearance path between the vehicle and the barrier constituting substantially the only opening through which sound might escape toward the position of a listener, the overlapping portion of said vehicle comprising a longitudinally elongated element protruding sideways from the side of the vehicle, and the overlapping portion of said barrier element defining a surface extending generally parallel to the direction of elongation of said vehicle element, said thus defined clearance path presenting a bend to the emission of noise from beneath the vehicle, and an expense of sound absorbent material disposed adjacent said bend, positioned to absorb and thereby attenuate sound energy escaping through said bend.

2. The system of claim 1 wherein said sound absorbent material is disposed to diminish the sound intensity to reduce the reverberant qualities of the sound chamber defined between the road bed, said upstanding barrier, and said moving vehicle.

3. The system of claim 1 wherein the upper portion of said barrier defines a walkway.

4. The sound control system of claim 1 wherein said sound absorbent material is separate from and attached to said upstanding barrier element.

5. A sound control system for a moving rail vehicle comprising a closed road bed surface upon which the rails are mounted, and an upstanding closed, sound barrier element arranged to co-act with the moving rail vehicle to block lines of sight from the sound source beneath the vehicle to the exterior, said upstanding barrier and said moving vehicle including overlapping portions, defining a clearance path between the vehicle and the barrier, said path presenting a bend to the emission of noise from beneath the vehicle, and an expanse of sound absorbent material disposed adjacent said bend, positioned to absorb and thereby attenuate sound energy escaping through said bend and wherein said barrier defines a top element which extends generally horizontally, said sound absorbent material disposed along the underside of said top element in a position protected by said element.

6. The system of claim 5 wherein the upper surface of said top element defines a walkway.

* * * * *

UNITED STATES PATENT AND TRADEMARK OFFICE

CERTIFICATE OF CORRECTION

PATENT NO. : 4,138,947

DATED : February 13, 1979

INVENTOR(S) : William H. Pickett

It is certified that error appears in the above-identified patent and that said Letters Patent are hereby corrected as shown below:

Column 1, line 53, "cause" should be --case--;
" 3, line 59, "in" should be --the--;
" 4, " 47, after "downwardly" insert--directed--
" 6, " 18, "Fo" should be --For--;
" 9, " 63, "reinformed" should be--reinforced--
" 12, " 18, "expense" should be --expanse--.

Signed and Sealed this

*Twenty-ninth* Day of *May 1979*

[SEAL]

*Attest:*

RUTH C. MASON
*Attesting Officer*

DONALD W. BANNER
*Commissioner of Patents and Trademarks*